United States Patent [19]

Warzinski

[11] Patent Number: 4,675,101

[45] Date of Patent: Jun. 23, 1987

[54] STEP-WISE SUPERCRITICAL EXTRACTION OF CARBONACEOUS RESIDUA

[75] Inventor: Robert P. Warzinski, Venetia, Pa.

[73] Assignee: The United States of America as represented by the United States Department of Energy, Washington, D.C.

[21] Appl. No.: 863,494

[22] Filed: May 15, 1986

[51] Int. Cl.[4] ..... C10G 1/04

[52] U.S. Cl. ..... 208/311; 208/309; 208/313; 208/314; 208/952

[58] Field of Search ..... 208/309, 311, 313, 314, 208/952

[56] References Cited

U.S. PATENT DOCUMENTS

| | | | |
|---|---|---|---|
| 2,980,602 | 4/1961 | Garwin | 208/45 |
| 3,607,717 | 9/1971 | Rosch | 208/425 |
| 3,969,196 | 7/1976 | Zosel | 208/390 |
| 3,970,541 | 7/1976 | Williams et al. | 208/428 |
| 4,108,760 | 8/1978 | Williams et al. | 208/390 |
| 4,192,731 | 3/1980 | Stearns et al. | 208/390 |
| 4,201,660 | 5/1980 | Zosel | 208/309 |
| 4,354,922 | 10/1982 | Derbyshire et al. | 208/68 |
| 4,402,821 | 9/1983 | Yan | 208/415 |
| 4,482,453 | 11/1984 | Coombs et al. | 208/309 |
| 4,502,944 | 3/1985 | Nelson | 208/45 |

OTHER PUBLICATIONS

Warzinski et al., Fuel; 1984, vol. 63, 1619–1622.
Warzinski, Syn Fuel Characterization, 1984, 9–10, 12.
Zosel, Agnew. Chem. Int.-Ed. 17, 702–709.
Warsinzki, Am. Chem. Soc., vol. 30, (3) 1985, 139–147.
Warsinski et al., Am. Chem. Soc., vol. 30, (4), 1985, 242–249.

*Primary Examiner*—Asok Pal
*Attorney, Agent, or Firm*—Hugh W. Glenn; Robert J. Fisher; Judson R. Hightower

[57] ABSTRACT

A method of fractionating a mixture containing high boiling carbonaceous material and normally solid mineral matter includes processing with a plurality of different supercritical solvents. The mixture is treated with a first solvent of high critical temperature and solvent capacity to extract a large fraction as solute. The solute is released as liquid from solvent and successively treated with other supercritical solvents of different critical values to extract fractions of differing properties. Fractionation can be supplemented by solute reflux over a temperature gradient, pressure let down in steps and extractions at varying temperature and pressure values.

17 Claims, 3 Drawing Figures

STEP-WISE SUPERCRITICAL EXTRACTION OF CARBONACEOUS RESIDUA

CONTRACTUAL ORIGIN OF THE INVENTION

The United States Government has rights in this invention due to the Employer/Employee Relationship of the inventor to the U.S. Department of Energy at the Pittsburgh Energy Research and Technology Center.

BACKGROUND OF THE INVENTION

This invention relates to a method of fractionating a mixture of high boiling carbonaceous material including normally solid carbonaceous material and mineral matter. In particular, supercritical and near supercritical fluids are used in extraction and fractionation of the materials.

Recent developments in the processing of fossil fuels have resulted in products and residua of extremely complex and intractable nature. This is especially true of the residua generated during coal liquefaction and various other processes involving heavy petroleum fractions, tarsands, shales, etc. Often such residua decompose prior to boiling and cannot be fractionated by conventional distillation processes.

In other developments, supercritical fluids have been used for extracting and fractionating organic substances. Representative of these developments are U.S. Pat. No. 3,969,196 to Zosel; U.S. Pat. No. 4,354,922 to Derbyshire et al.; U.S. Pat. No. 4,482,453 to Commes et al. and U.S. Pat. No. 4,502,944 to Nelson. These prior developments involve multi-step procedures in which process conditions of a supercritical fluid are varied to extract and separate product fractions. Even with this existing technology, there remains a need for improvements in separating and fractionating intractable, carbonaceous residua that also include solid mineral matter.

It is known that certain gas phases maintained near to supercritical conditions are capable of taking up large amounts of solutes from liquid or solid materials. When conditions such as temperature or pressure are reduced to below critical, a substantial decrease in solubility results. Also increases, particularly in temperature, to well above critical likewise reduce solubility in the supercritical gas. For purposes of this application, the terms "supercritical solvent", "supercritical phase", or "supercritical fluid" refer to a gas or gas mixture possibly with solute at or above critical temperature and critical pressure. The use of supercritical fluids to fractionate substances in a manner analogous to fractional distillation is termed "fractional destraction" in this application.

SUMMARY OF THE INVENTION

Therefore, it is an object of the present invention to provide an improved method of fractionating heavy, carbonaceous material including normally solid mineral matter.

It is a further object to provide a method of separating high boiling carbonaceous residua from solid mineral matter with minimal loss of carbonaceous material.

It is also an object to provide a method of fractionating high boiling residua at temperature and pressures below the boiling or decomposition conditions of the residua fractions.

In accordance with the present invention, a method is provided for fractionating a mixture containing high boiling carbonaceous material and normally solid mineral matter. The method includes contacting the mixture in mass-transfer relation with a first supercritical solvent at temperature and pressure above the critical values for the solvent but below vaporization temperature of the mixture. A major fraction of the carbonaceous material is extracted as a first solute into the first solvent from the normally solid mineral matter. The first solute is released as liquid from supercritical phase leaving the solvent in gas phase. After separating from the gas, the released liquid is contacted with a second solvent at above critical values to extract a second solute fraction into supercritical phase. The second solvent has a critical temperature less than that of the first solvent. The second solute is released from the supercritical phase to form a second released liquid of higher average volatility than the first released liquid.

In other aspects of the invention, third and successive solvents at supercritical conditions contact the second and successive residual liquids to extract a series of successive solutes into supercritical phase. The solutes are separately released from supercritical phase to provide a succession of liquids exhibiting a direct or inverse progression of properties such as volatility, average molecular weight, hydrogen to carbon ratio and solubility. Where the selected solvents have an upward progression of critical temperatures and an upward progression of operation temperatures from the second to the final contacting stages, the released liquids can be expected to have a progression of decreasing volatility.

In yet other aspects of the invention, the mixture of high boiling carbonaceous material and solid mineral matter exhibits atmospheric boiling points or decomposition temperatures above 300° C.

In yet other aspects of the invention, the mixture of normally solid mineral matter and carbonaceous material includes a high boiling fraction from a coal liqufaction process. Each of the solvents selected for use have critical temperatures below the boiling temperatures of a major portion of the carbonaceous material in the mixture. Typically, solvents with critical temperatures of between 200° and 400° C. are selected.

In other aspects of the invention, the solute is successively released from the supercritical solvent in a series of steps to provide a plurality of separate liquid fractions of different solubilities. The stepwise release can be accomplished by successive depressurization steps or by successive increases in temperatures. In a continuous fractionation process, the second solvent with solute in supercritical phase is continuously contacted with a reflux solute at temperatures from about 70° C. above the critical temperature down to or near the critical temperature of the solvent.

One other manner of fractionating the second solute is to contact the released liquid from a previous stage with a supercritical solvent in a progression of increasing pressure steps. This extracts a series of solute fractions having decreasing solubilities. These solute fractions are subsequently released from solvent by reducing the pressure of each fraction to below the critical pressure.

DETAILED DESCRIPTION OF THE DRAWINGS

The present invention is illustrated in the accompanying drawings wherein.

DETAILED DESCRIPTION OF THE PREFERRED EMBODIMENTS

In carrying out the method of the present invention, a residual material, such as a high boiling residuum from a coal liquefaction process is contacted in a series of steps with a plurality of different solvents at above critical values. The residuum may contain both solid mineral matter and very high boiling, difficult to dissolve, carbonaceous material of organic origin.

Figure 1:
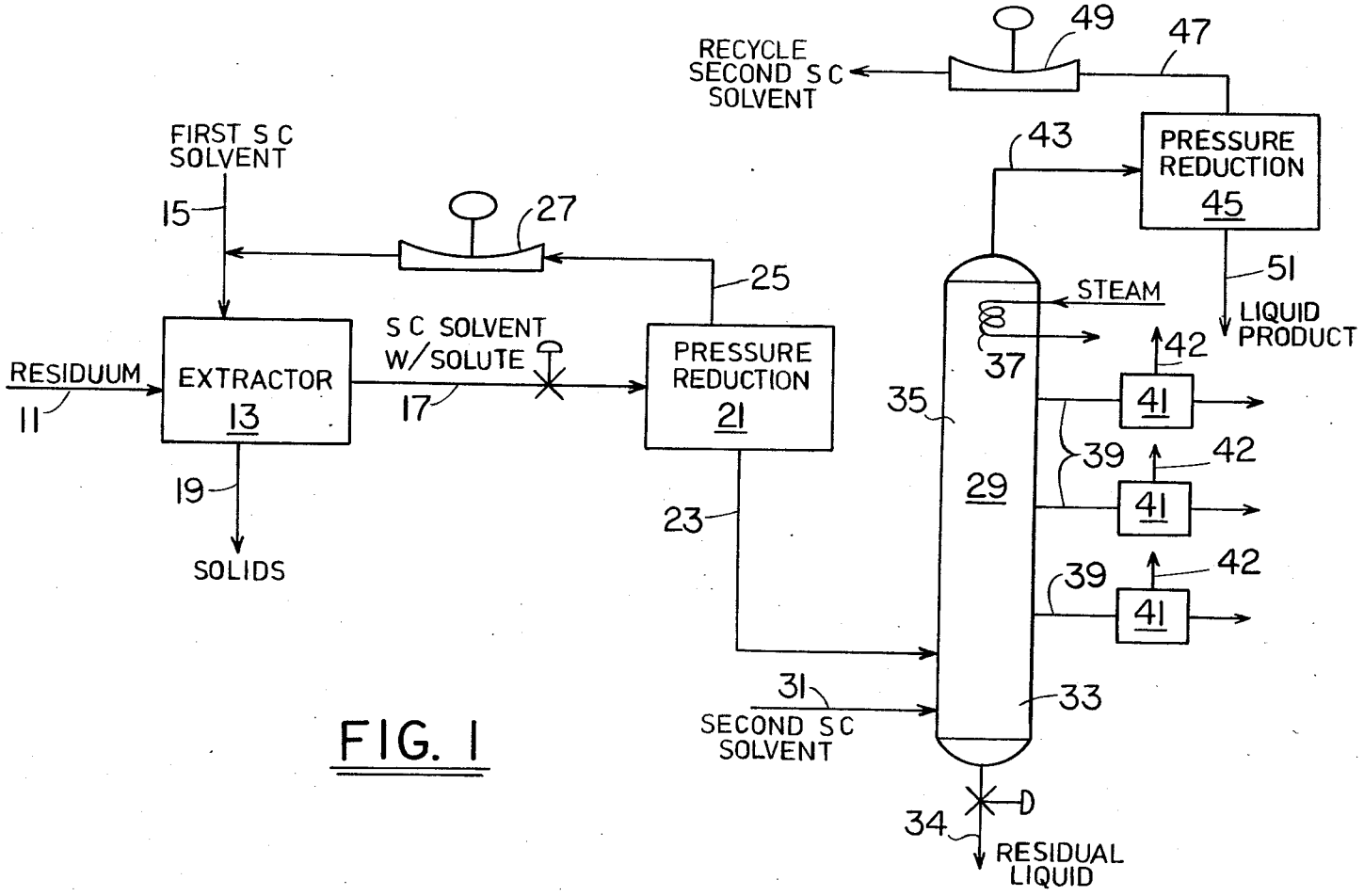
FIG. 1 is a schematic flow diagram of a fractionation process employing supercritical solvents.

In FIG. 1, a multiple solvent, fractional destraction process is illustrated for providing a plurality of liquid fractions from an intractable residual material. Residuum 11 enters an extractor 13 where it is contacted with a first supercritical solvent 15 at temperatures and pressures above the critical values of the solvent. Extractor 13 can be of various types of known liquid-gas, liquid-liquid or gas-liquid-solid contacting equipment. For example, a vessel or column containing a sparger or other means for distributing the supercritical solvent into a liquid-solid residuum can be used.

Carbonaceous solute from residuum 11 is extracted into the supercritical solvent 15 and is withdrawn from extractor 13 at conduit 17. The residual solids 19 are removed for further processing or disposal. The supercritical solvent, pregnant with solute in conduit 17 is subjected to pressure reduction in vessel 21 to below the critical pressure of the solvent. The pressure reduction results in a released carbonaceous liquid at 23 and a solvent gas flow at 25. The solvent gas is recompressed in compressor 27 and recycled with temperature adjustments to extractor 13.

In the extraction step at 13 and in subsequent contacting operations, the supercritical solvent is maintained at a temperature above but near to its critical temperature. Typically, no more than 50°–70° C. above the critical temperature is employed. In the initial extraction at 13, the supercritical solvent is maintained as near as possible to the critical temperature to maximize the take up of solute. For example, a temperature of about 1.02 of the absolute critical temperature (Tc) will assure the presence of a supercritical phase but yet take full advantage of enhanced solubility near the critical temperature.

As illustrated, the released liquid at 23 is passed to a fractional destraction column 29 for further fractionation with a second supercritical solvent 31. Typically, column 29 will include a lower portion 33 for introducting released carbonaceous liquid 23 and the second supercritical solvent 31. Solvent 31 advantageously is introduced through a sparger or some other suitable dispersion device into a level of carbonaceous liquid.

The residual liquid that is not taken up by the supercritical solvent is withdrawn at 34. This liquid fraction will be of low solubility, hydrogen to carbon ratio, and volatility relative to the other fractions withdrawn from the upper portion 35 of column 29.

The upper portion 35 of column 29 can include an inert packing for providing contact sites between the reflux liquid and supercritical solvent. It will be clear that sieve or bubble cap trays used in distillation processes and other gas-liquid or liquid-liquid contacting devices also can be used.

Reflux of solute within column 29 is provided by a heater means 37, illustrated as a coil for passage of steam at the top of column 29. On increasing the temperature of the supercritical solvent at the top of column 29 to temperatures up to not more than about 70° C. above the critical temperature will release a fraction of solute as reflux liquid within the column. As the reflux liquid flows downwardly in contact with upwardly flowing supercritical solvent, a continuous exchange of solute between liquid and supercritical phase occurs in accord with a temperature gradient established between the upper and lower portions of column 29. Consequently, a plurality of product fractions 39 can be withdrawn along the height of column 29. Fractions 39 can be withdrawn as supercritical solvent or as released liquid solute but if withdrawn as supercritical solvent, pressure let-down chambers 41 are used to separate the liquid solute from the supercritical solvent.

The supercritical solvent leaving column 29 at 43 will contain a highly soluble and volatile liquid solute. On reducing the pressure to below critical in chamber 45, the volatile solute is released and withdrawn at 51 as a premium, ash-free product. The solvent gas 47 at below critical conditions is recompressed in compressor 49 with temperature adjustments (not illustrated) and recycled at 31 into the lower portion of column 29. Gases 42 from Chambers 41 also can be recompressed and recycled as supercritical solvent.

EXAMPLE 1

In a process to simulate the FIG. 1 embodiment, a coal derived residuum containing solids is contacted with toluene at a temperature of 1.02 times the absolute critical temperature and a pressure of twice the critical pressure. About 70% of the residuum is extracted into the supercritical toluene and released on pressure reduction to below the critical pressure. The released solute with minimal ash content is then fractionated with cyclohexane in a fractional destraction device. Four overhead fractions are collected at 320° C., 305° C., 300° C., and 290° C. These overhead fractions amount to about 40% of the original residuum feed. The residual carbonaceous liquid that is not taken up by the supercritical cyclohexane and the solids rich fraction from the toluene extraction each amount to for about 30% of the feed residuum. Table 1 below gives analyses of various fractions collected in a series of batch operations. This data is presented as potential performance of the process of this example. The average molecular weights ($\overline{M}n$) are taken from vapor pressure osmometry (VPO) data.

TABLE 1

| | Elements (wt %) | | | | | | | |
|---|---|---|---|---|---|---|---|---|
| | C | H | O | N | S | H/C | $\overline{M}_n$ (VPO) | Ash (wt %) |
| Feed Residuum | 78.6 | 5.3 | (5.2)+ | 1.1 | (1.1)+ | 0.809 | — | 13.2 |
| Cyclohexane Overheads: | | | | | | | | |
| #1 (593 K)* | 88.2 | 6.9 | 2.8 | 0.9 | 0.3 | 0.928 | 388 | <0.1 |
| #2 (578 K)* | 88.9 | 6.7 | 3.3 | 0.9 | 0.3 | 0.901 | 443 | <0.1 |
| #3 (573 K)* | 89.0 | 6.4 | 3.2 | 1.0 | 0.3 | 0.866 | 525 | <0.1 |

TABLE 1-continued

| | Elements (wt %) | | | | | | | |
|---|---|---|---|---|---|---|---|---|
| | C | H | O | N | S | H/C | $\overline{M}_n$ (VPO) | Ash (wt %) |
| #4 (563 K)* | 89.6 | 6.0 | 3.1 | 1.2 | 0.3 | 0.807 | 578 | <0.1 |
| Cyclohexane Residue | 89.6 | 5.3 | 3.5 | 1.4 | 0.2 | 0.713 | 1070 | <0.1 |
| Toluene Residue | 44.8 | 2.6 | (12.7)+ | 0.7 | (4.6)+ | 0.718 | — | 46.1 |

*Reflux Zone Temperature
+ Includes Mineral Matter Contributions

It is clearly seen that only minimal ash is carried into the overhead product or to the residual carbonaceous liquid from the cyclohexane extraction. Furthermore, fractions with increased hydrogen to carbon ratios and lower average molecular weight are obtained in the fractions collected at elevated overhead temperatures. Also, one may expect an inverse relation of molecular weight to product volatility.

It is also seen that the released solute from the toluene extraction can be regarded as the combination of the cylcohexane residue and the four overhead fractions. It is clear that this first released solute is of greater average molecular weight, lower hydrogen to carbon ratio and lower volatility than subsequent fractions.

Various solvents can be selected for use as supercritical solvents in the process of this invention. The solvents are selected by their chemical and physical compatability with the materials to be fractionated. In addition, the solubility of the residuum in the solvent as well as the solvent in the solute fractions is considered. Moreover, the critical temperature and critical pressure of the solvent are of particular importance as they dictate the operating conditions of the process. The solvents preferably have critical temperatures below the vaporization and decomposition temperatures of the expected fractions to be recovered at the critical pressure of the solvent. This permits the critical and operating temperatures to be below the boiling and decomposition temperatures of the fractions at the operating pressure of the method.

Solvent mixtures can be prepared to provide desired critical conditions and other physical and chemical properties of a desired solvent. Table 2 below lists the critical constants for a number of solvents contemplated for use either alone or in mixture with other solvents, in carrying out the present invention.

TABLE 2

| | Critical Constants | |
|---|---|---|
| Solvent | Tc °K. | Pc Atm |
| Carbon Dioxide | 304 | 75 |
| Butane | 425 | 37 |
| Methylpropane | 408 | 36.5 |
| N—Pentane | 470 | 33.1 |
| 2 Methylbutane | 461 | 32.9 |
| 2-2-Dimethylpropane | 433 | 32.3 |
| Hexane | 508 | 29.9 |
| 2 Methylpentane | 498 | 29.9 |
| 3 Methylpentane | 505 | 30.8 |
| 2,2-Dimethylbutane | 489 | 30.7 |
| 2,3-Dimethylbutane | 500 | 31 |
| Methanol | 512 | 79.2 |
| Cyclohexane | 553 | 40.1 |
| Benzene | 562 | 49 |
| Toluene | 593 | 41.7 |
| Pyridine | 620 | 55.6 |

Figure 2:
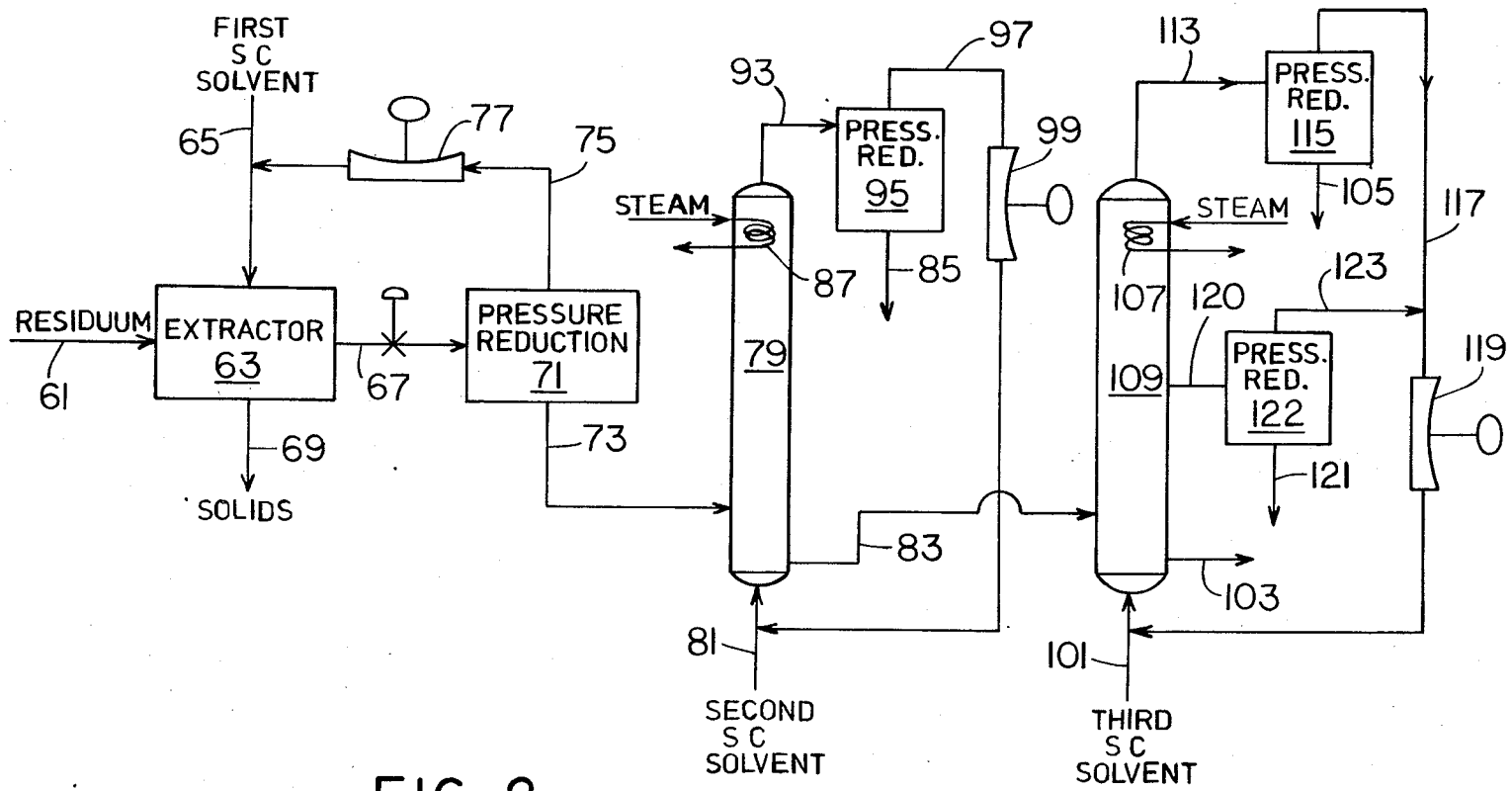
FIG. 2 is a schematic flow diagram of an expanded fractionation process with supercritical solvents.

Referring now to FIG. 2 where a more expanded form of the present process is illustrated. Residuum 61 is contacted with supercritical solvent 65 in extractor 63 with the removal of solids 69 and the pressure reduction of pregnant supercritical solvent 67 at 71. The released solvent gas 75 is recompressed at 77 with adjustments in temperature before returning to the extractor 63. The released liquid 73 is forwarded to a fractional destraction column 79 for contact and fractionation with a second supercritical solvent 81 and solute reflux provided by heater coil 87. As illustrated, released carbonaceous liquid 73 is fractionated into an overhead stream 93 and a residual liquid stream 83. It will be clear that several fractions can be taken from column 79 along its height as was illustrated and described in the FIG. 1 process.

The pregnant supercritical solvent 93, following pressure reduction in vessel 95, separates into carbonaceous liquid 85 and recycle solvent gas 97 for recompression in compressor 99, temperature adjustment and recyle into the lower portion of destraction column 79.

The heavy liquid fraction 83 is passed on to a second destraction column 109 for further fractionated with a third supercritical solvent 101. As previously described, heater coil 107 provides a liquid reflux for fractionating the solute into a plurality of fractions illustrated as the pregnant supercritical solvent 113, the residual carbonaceous liquid 103 and the intermediate fraction 120. Pressure reduction at 115 and 122 permit recycle of the solvent gases 117 and 123 for recompression at 119 and return to column 109. Thus intermediate 121 and high volatile 105 fractions of carbonaceous liquid are recovered.

The use of this method as thus described permits much flexibility in the fractionation of an intractable residual material. Solid material is removed in an early step to prevent fouling of the later-fractionating stages. Through use of the plurality of supercritical solvents, fractionation can occur at temperatures well below the boiling temperature at the collection pressure. The process is well suited for separating carbonaceous fractions that decompose before boiling and therefore cannot be separated by distillation processes.

Advantageously, the first supercritical solvent is selected to have a high critical temperature and high solubility for taking up a large fraction of the carbonaceous material in the residuum. Following the release of the solute liquid from supercritical phase, subsequent processing with other supercritical solvents can be carried out to fractionate the released liquid. The second and subsequent supercritical solvents are advantageously selected to have critical temperatures in upward progression. This permits early recovery at low operating temperatures of the more soluble and volatile materials. Subsequent fractional destraction with third and successive supercritical solvents can employ progressively higher operating temperatures with solvents of increasing critical temperatures up to that of the initial extraction step. Furthermore, particular solvents can be selected to be directed to the extraction of particularly intractable fractions. Such flexibility previously has not been realized in distillation or single-solvent supercritical processing.

EXAMPLE 2

A coal derived residuum is extracted with toluene, n-pentane and cyclohexane to simulate the process of FIG. 2. Temperatures of about 1.02–1.1 times the absolute critical temperature and pressures of about 2 times the critical pressure were used in the extraction and fractional destraction operation. About 70% by weight of the feed residuum is extracted into supercritical toluene. After release from supercritical phase about 40% by weight of the released liquid is extracted into supercritical n-pentane and recovered as a light product fraction. The residual liquid from the n-pentane is passed to a second fractional destraction operation where supercritical cyclohexane is used to fractionate that residual liquid into extracted fractions of about 25% and 45% and a cyclohexane residuum of about 30% by weight.

Figure 3:
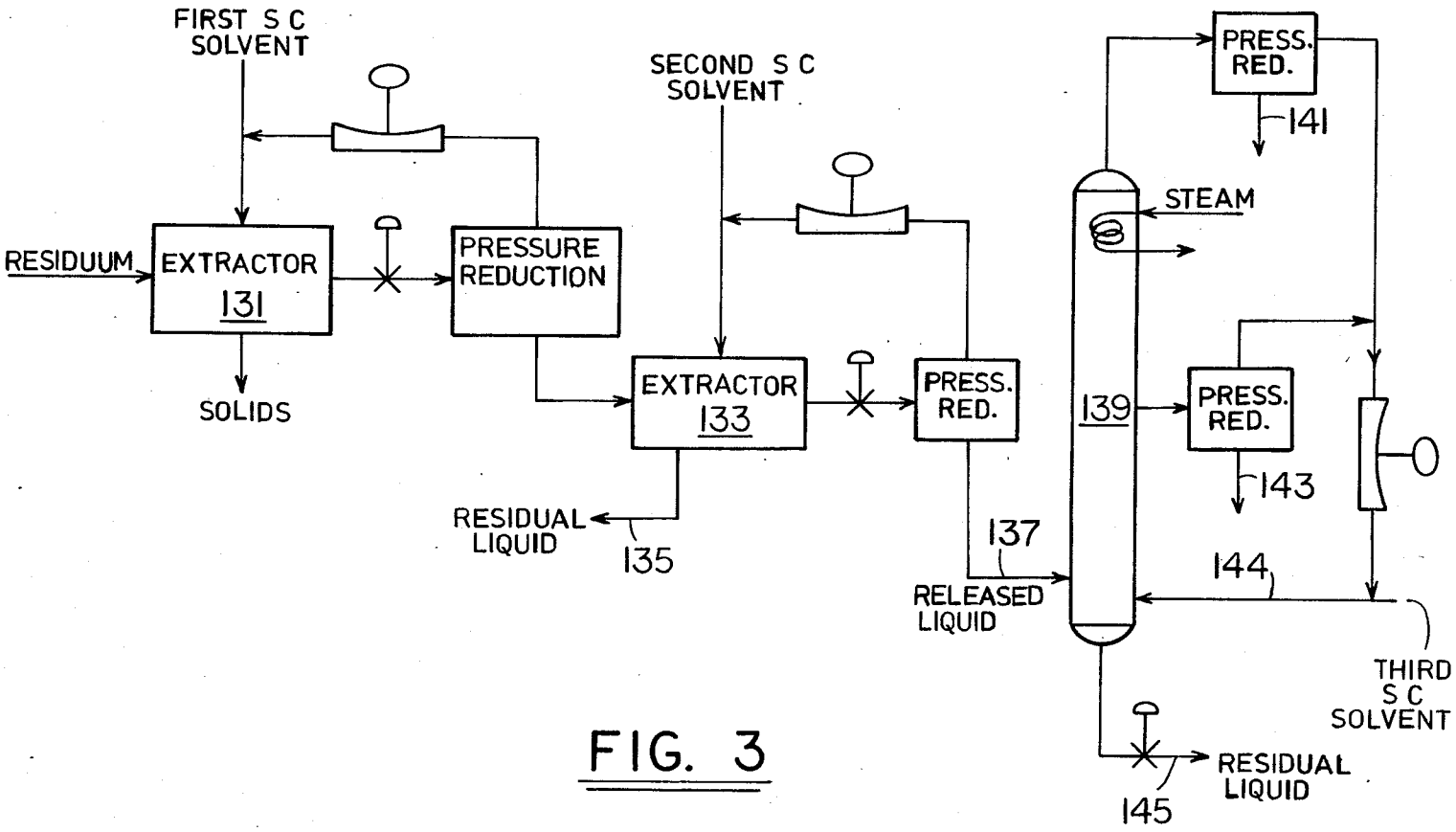
FIG. 3 is a schematic flow diagram showing a modified fractionation process with supercritical solvents.

In FIG. 3 a plurality of extraction steps 131 and 133 are performed as previously described except that the residual carbonaceous liquid 135 after the second extraction is available as a product fraction. This is achieved by passing forward the released solute liquid 137 to subsequent extraction or destraction steps as illustrated at 139 with a third supercritical solvent 144. In a final fractional destraction step, a plurality of product fractions 141 and 143 along with a residual carbonaceous liquid 145 can be recovered as described above.

This process variation gives additional flexibility in employing a plurality of supercritical solvents in the fractionation of the high boiling residual material. Early recovery of the high boiling, high molecular weight material can be obtained. Solvents with progressively decreasing critical temperatures are selected to provide fractions of progressively increasing volatility and solubility or of progressively decreasing molecular weight.

Although fractional destraction has been described in the above method as involving a continuous process with temperature activated reflux, it will be clear that other techniques may be used. Batch and batch stage contact with supercritical solvent and refluxed solute can be used. Also, fractionation can be obtained by contacting the residual or released liquids with a second supercritical solvent in a progression of steps each with increased pressure. For instance, pressures of 1.0 to about 4 times supercritical pressures in three to five steps can provide a plurality of solute fractions of varying solubility or volatility. Similarly, residual material can be contacted with a second supercritical solvent in a plurality of temperature decreasing stages to extract a series of solute fractions of varying properties.

It is therefore seen that the present invention provides a method of fractionation heavy, intractable, carbonaceous material that includes normally solid mineral matter. Solid mineral matter is removed in a first extraction with a supercritical solvent. In subsequent extraction and fractional destraction steps involving other solvents, the initial solute can be divided into a plurality of fractions. All of the extractions and fractionations can be performed at temperatures well below boiling or decomposition temperatures of the carbonaceous material through use of a plurality of carefully selected supercritical solvents.

Although the present invention is described in terms of the specific embodiments, it will be clear that various changes in the materials, processing conditions, parts and details of the invention can be made by one skilled in the art within the scope of the appended claims.

The embodiments of this invention in which an exclusive property or priviledge is claimed are defined as follows:

1. A method of fractionating a mixture containing high boiling carbonaceous material and normally solid mineral matter comprising:

contracting the mixture in mass transfer relation with a first solvent including toluene at temperature and pressure above critical values for the solvent to extract a first solute containing a major fraction of the carbonaceous material into supercritical phase with the first solvent while leaving a first residual fraction;

reducing the pressure of the first solvent with solute to below the critical pressure of the first solvent to release from supercritical phase the first solute as a first released liquid and the first solvent as a gas;

compressing the solvent gas to above its critical pressure for recycle into contact with said mixture;

contacting the first released liquid with a second solvent different from said first solvent at a temperature and pressure above critical values to extract a second solute into supercritical phase with the second solvent leaving a second residual fraction; said second solvent including cyclohexane and having a critical temperature less than that of said first solvent, and reducing the pressure of the second solvent with solute to below the critical pressure of the second solvent to release from supercritical phase the second solute as a second released liquid and the second solvent as a gas, said second released liquid being of higher average volatility than said first released liquid;

compressing the second solvent gas to above its critical pressure for recycle into contact with the liquid.

2. The method of claim 1 wherein third and successive solvents at supercritical conditions contact the second and successive residual fractions to extract third and successive solutes respectively into supercritical phase, and wherein said solutes are released form a progression of released liquids.

3. The method of claim 2 wherein said third and successive solvents have critical temperatures in an upward progression between that of said second solvent to that of said first solvent.

4. The method of claim 1, wherein the mixture to be fractionated is a high boiling fraction from a coal liquefaction process and consists essentially of normally solid mineral matter and carbonaceous substances having boiling and decomposition temperatures above 300° C. at the pressures of said method.

5. The method claim 4 wherein said solvents have critical temperatures below the boiling and decomposition temperatures of the extracted carbonaceous substances at the pressures of said method.

6. The method of claim 1, wherein said first and second solvents have critical temperatures below the boiling temperatures of a major portion of the carbonaceous material in the mixture at the critical pressure of the solvents.

7. The method of claim 6, wherein the critical temperature of the first and second solvents are between 200° C. and 400° C.

8. The method of claim 1, wherein each of the supercritical solvents contact the carbonaceous material at a temperature less than 70° C. above the critical temperature of the solvent.

9. The method of claim 8 wherein said solvents contact the carbonaceous material at a temperature of about 1.02–1.1 times the absolute critical temperature of the solvent.

10. The method of claim 1, wherein the second solvent with solute is successively subjected to stepwise release of a plurality of separate liquid fractions of differing solubilities.

11. The method of claim 10, wherein the step-wise release of liquid fractions is accomplished by successive depressurization steps, each step releasing a fraction of increased solubility over the proceeding step.

12. The method of claim 10, wherein the step-wise release of liquid fractions is accomplished by successive temperature increase in steps, each step releasing a fraction of increased solubility over the proceeding step.

13. The method of claim 1, wherein the first released liquid is contacted with a second solvent in a progression of increased pressure steps to extract a series of solute fractions having decreasing solubilities.

14. The method of claim 1, wherein the second solvent with solute in supercritical phase is continously fractionated by contact with reflux solute at temperatures from about 50° C. above critical down to near critical temperature of the solvent.

15. The method of claim 1 wherein said second released liquid is contacted with a third solvent, different from said first and second solvents, at a temperature and pressure above the critical values for the third solvent to extract a third solute into supercritical phase, and wherein said third solute is released from supercritical phase to form a third released liquid, said first, second and third solvents having critical temperatures in a downward progression from the critical temperature of the first solvent to the critical temperature of the third solvent.

16. A method of fractionating a coal derived mixture containing high boiling carbonaceous material and normally solid mineral matter comprising:

contacting the mixture with toluene in supercritical phase at a temperature of about 1.02 to 1.1 of the critical temperature and a pressure of about twice the critical pressure of toluene to extract a first solute into supercritical phase leaving a first residual fraction;

reducing the pressure of the toluene with first solute to below the critical pressure of toluene to release from supercritical phase a first released liquid and toluene as a gas, compressing the toluene gas to above its critical pressure and temperature for recycle into contact with the mixture;

contacting the first released liquid with cyclohexane in supercritical phase at temperatures of about 1.02 to 1.1 of the absolute critical temperature of cyclohexane to extract a second solute into supercritical phase leaving a second residual fraction;

increasing the temperature of the cyclohexane with second solute to not more than 70° K. above the critical temperature thereof to release and reflux a portion of said second solute as liquid into contact with said cyclohexane in supercritical phase;

reducing the pressure of the cyclohexane with second solute to below the critical pressure of cyclohexane to release from supercritical phase, a second released liquid and cyclohexane as a gas, said second released liquid having a lower average molecular weight, higher hydrogen to carbon ratio and higher volatility than said first released liquid;

compressing the cyclohexane gas to above its critical pressure and temperature for recycle into contact with the first released liquid.

17. A method of fractionating a high boiling coal derived mixture containing normally solid mineral matter comprising:

contacting the mixture with toluene at a temperature about 1.02 to 1.1 times the absolute critical temperature of toluene and a pressure of about two times the critical pressure of toluene to extract a first solute into supercritical phase leaving a residual fraction including the normally solid mineral matter;

reducing the pressure of the toluene with first solute to below the critical pressure of toluene to release from supercritical phase, a first released liquid and toluene as a gas;

compressing the toluene gas to above its critical pressure and temperature for recycle into contact with the mixture;

contacting the first released liquid with n-pentane at a temperature of about 1.02 to 1.1 of the absolute critical temperature of n-pentane and at a pressure of about twice the critical pressure of n-pentane to extract a second solute into supercritical phase leaving a residual liquid;

reducing the pressure of the n-pentane with second solute to below the critical pressure of n-pentane to release from supercritical phase, a second released liquid and n-pentane as a gas;

compressing the n-pentene gas to above its critical pressure and temperature for recycle into contact with the first released liquid;

contacting the residual liquid with cyclohexane in supercritical phase at a temperature of about 1.02 to 1.1 of the absolute critical temperature of cyclohexane to extract a third solute into a supercritical phase;

reducing the pressure of the cyclohexane with third solute to below the critical pressure of cyclohexane to release from supercritical phase, a third released liquid and cyclohexane as a gas;

compressing the cyclohexane to above its critical pressure and temperature for recycle into contact with the residual liquid;

collecting the second and third released liquid as separate product fractions.

* * * * *